United States Patent [19]

Van Steenburgh, Jr.

[11] Patent Number: 4,998,416

[45] Date of Patent: Mar. 12, 1991

[54] REFRIGERANT RECLAIM METHOD AND APPARATUS

[76] Inventor: Leon R. Van Steenburgh, Jr., 850 East La., Estes Park, Colo. 80515

[21] Appl. No.: 258,166

[22] Filed: Oct. 14, 1988

Related U.S. Application Data

[63] Continuation-in-part of Ser. No. 109,958, Oct. 19, 1987.

[51] Int. Cl.[5] ..... F25B 45/00

[52] U.S. Cl. ..... 62/292; 62/77

[58] Field of Search ..... 62/149, 77, 292, 475, 62/503, 505, 513, 174

[56] References Cited

U.S. PATENT DOCUMENTS

| | | | |
|---|---|---|---|
| 3,232,070 | 2/1966 | Sparano | 62/149 |
| 4,285,206 | 8/1981 | Koser | 62/126 |
| 4,364,236 | 12/1982 | Lower et al. | 62/77 |
| 4,601,177 | 7/1986 | Tanino et al. | 62/149 |
| 4,739,632 | 4/1988 | Fry | 62/505 |
| 4,766,733 | 8/1988 | Scuderi | 62/292 |
| 4,768,347 | 9/1988 | Manz et al. | 62/149 |
| 4,805,416 | 2/1989 | Manz et al. | 62/292 |
| 4,809,515 | 3/1989 | Houwink | 62/77 |
| 4,809,520 | 3/1989 | Manz et al. | 62/292 |

*Primary Examiner*—Henry A. Bennet

*Attorney, Agent, or Firm*—Beaton & Swanson

[57] ABSTRACT

A refrigerant reclaim system including a compressor, a heat exchanger, an oil separator, a condenser, a chill tank, a filter-drier and a cooling coil in the chill tank. An improvement relates to means for preventing the premature destruction of the compressor pump by supplying the compressor with a liquid injection system and an oil sight glass. Further improvements relate to means for monitoring the level of refrigerant in the storage tank and means for adopting the refrigerant reclaim system to accept several different refrigerants by including a plurality of expansion valves which can selectively be placed on line.

10 Claims, 2 Drawing Sheets

REFRIGERANT RECLAIM METHOD AND APPARATUS

CROSS-REFERENCE TO RELATED APPLICATION

This is a continuation-in-part of copending application Ser. No. 109,958 filed Oct. 19, 1987, for "Refrigerant Reclaim Method and Apparatus."

1. Field of Invention

This invention relates to an apparatus for removing refrigerant from a refrigeration system during repairs, confining it so as to avoid its escape to the atmosphere, separating contaminants from the refrigerant and returning the refrigerant to the repaired refrigeration system or discharging it to a storage container.

2. Background of the Invention

In the past, little attention was paid to the storage or recycling of refrigerant. When refrigeration systems were being repaired or when the refrigerant, such as those sold under the trademark "Freon," was contaminated sufficiently to affect the effectiveness of refrigeration, the refrigerant was vented into the atmosphere.

Recent developments have, however, created a demand for systems capable of storing refrigerant while at the same time purifying the contaminated refrigerant. The United States, as have several other countries, has become a signatory of the "Montreal Protocol on Substances that Deplete the Ozone Layer", which restricts future productions of fully halogenated chlorofluorocarbons. Pursuant to this international mandate, future production of all currently used refrigerants are to be drastically cut by the end of the century. In addition to this development, the United States Environmental Protection Agency has classified several widely used refrigerants as hazardous substances under the Resource Conservation and Recovery Act ("RCRA").

The combination of these two regulatory developments accentuates the necessity for a device which will store and purify refrigerant, eliminating the possibility of unlawful emissions and the necessity for purchasing refrigerants in an artificially constrained market. The present invention relates to improvements on the refrigerant reclaim method and apparatus as described in co-pending U.S. application Ser. No. 109,958 of Van Steenburgh, Jr.

The patent application, Ser. No. 109,958, discloses an apparatus for drawing refrigerant from a container, or a refrigeration system to be repaired, heating the refrigerant sufficiently to maintain it in a gaseous state while it passes through an oil separator into the intake of a compressor. Compressed gaseous refrigerant is discharged from the compressor and passed through a heat exchanger to heat the incoming liquid refrigerant and then passes through to a condenser where it is liquefied. The liquefied refrigerant is passed from the condenser into a hold tank from the bottom of which liquid refrigerant flows through a filter-dryer and an expansion device for reconverting the liquid refrigerant to a gaseous form. From the expansion device the gaseous refrigerant passes through a coil submerged in the liquid in the hold tank and then is passed back to the intake of the compressor. The temperature of the liquid in the hold tank is lowered by the chilling effect of the expanding gaseous refrigerant passing through the coil submerged in the liquid. The refrigerant can be repeatedly passed from the chill tank through the filter-dryer, expansion device, cooling coil, compressor, heat exchanger, condenser and back to the hold tank. This repeated process will progressively lower the temperature of refrigerant in the hold tank, pass the refrigerant through the filter-dryer repeatedly, and, by lowering the temperature of the refrigerant, maximize the separation of air from the refrigerant.

The apparatus described in application Ser. No. 109,958 provides several advantages over the prior art. There are, however, several additional attributes that are desirable in refrigerant reclaim systems.

One difficulty seen in all previous reclaim systems is in preventing "burn out" of the compressor unit. Compressor burn out can result from several conditions. Occasionally, substantial amounts of liquid refrigerant is allowed to enter the compressor. When this "liquid slugging" occurs, the compressor will be destroyed, as the piston rods become bent. This results in the physical destruction of the compressor pistons. Another very common cause of compressor burn out is operation of the compressor with inadequate amounts of oil.

Finally, many compressor burn outs are a result of overheating. Hermetically sealed compressor pumps operate by allowing the cool refrigerant gas to pass directly over and around the electrical coils of the compressor motor. When the compressor is operated without sufficient amounts of cooling refrigerant entering the compressor, the motor will eventually overheat and the electrical coils will be destroyed.

The device disclosed in application Ser. No. 109,958 combines a uniquely designed oil separator with cooling tanks for subcooling the refrigerant. Subcooling of the refrigerant allows for greatly enhanced water and air separation from the refrigerant as well as facilitating the discharge of refrigerant into warmer vessels. Combining the cooling function into the reclaim unit requires the use of refrigerant-specific expansion valves Unfortunately, each of the commonly used refrigerants require a different expansion valve. Since several different refrigerants are often used, for example those refrigerants commonly referred to as R-12, R-22, R-502 and R-500, it would be desirable to incorporate features into a reclaim system whereby the system could easily reclaim several different refrigerants.

A final problem associated with any system that stores refrigerant is in the potential for overfilling storage tanks. Particularly when filling tanks with cooled refrigerant, it is possible to fill a storage tank to such a level that thermal expansion will create a potentially explosive buildup of pressure. Means for monitoring the level of liquid refrigerant in a refrigerant reclaim system is therefore a crucial element. Traditionally, physical means sensitive to pressure buildup are incorporated into such storage tanks. When the pressure exceeds a certain preset level, a valve will open and allow the refrigerant to vent into the atmosphere. Due to the environmental regulations prohibiting the release of refrigerant into the atmosphere, this is a less than satisfactory solution to this problem.

SUMMARY OF THE INVENTION

The present invention provides means for drawing refrigerant from a container and removing oil, water and other contaminants. This invention specifically relates to means for preventing the premature destruction of compressor pumps that allow the user to systematically check for oil loss in the compressor by use of a sight glass. This invention also provides means for cooling the compressor electrical coils when a minimal amount of gaseous refrigerant is entering the compressor by injecting a controlled amount of cooled liquid refrigerant directly unto the compressor coils. The present invention also relates to means for monitoring the level of refrigerant in the storage tank in order to prevent over filling by use of an externally attached float device. And, finally, this invention provides means for adapting the refrigerant reclaim system to accept several different refrigerants by including a plurality of expansion valves which can be selectively placed online.

The invention can be more fully understood when the detailed description which follows is read with reference to the accompanying drawings.

DRAWINGS

DETAILED DESCRIPTION

Figure 1:
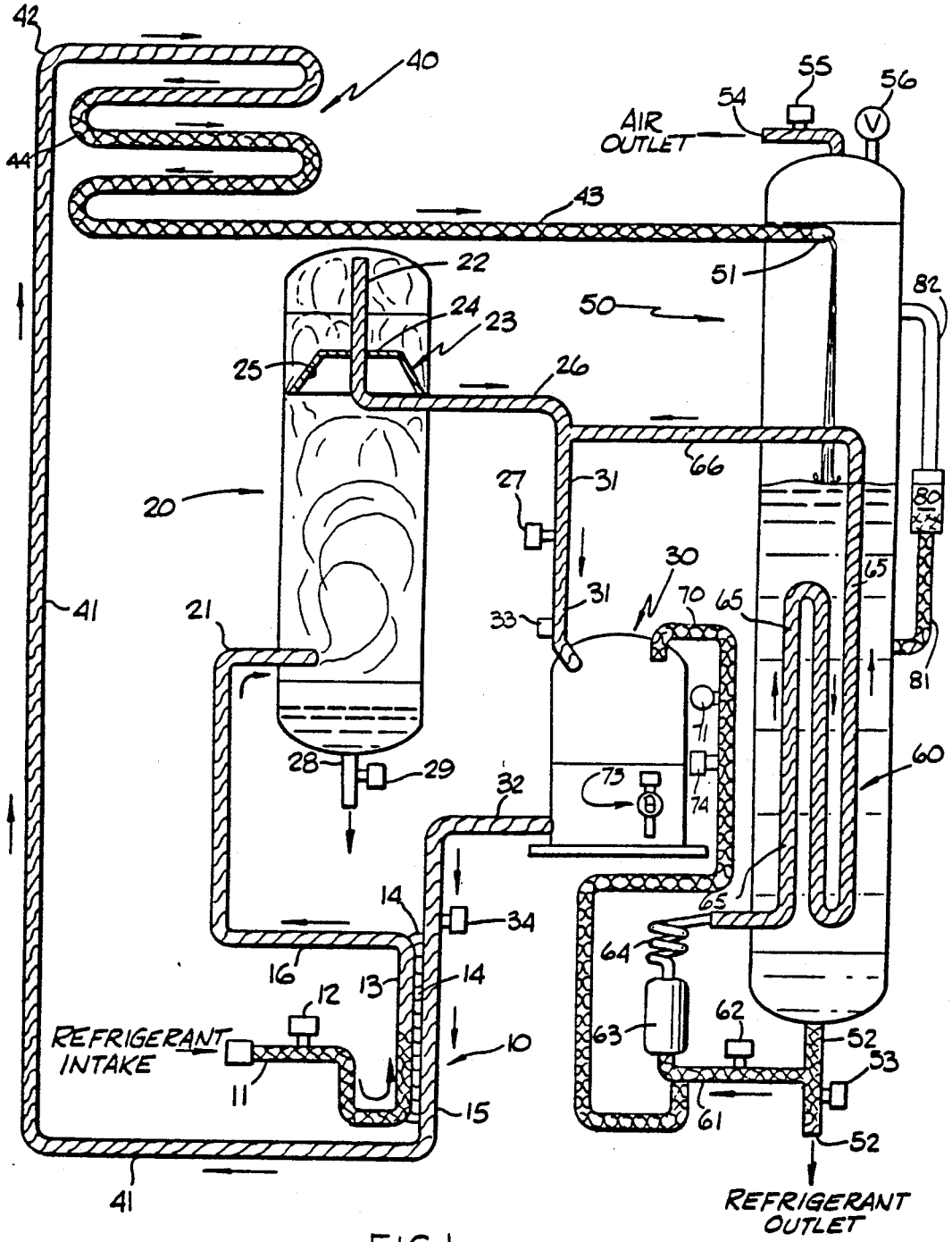
FIG. 1 is a schematic illustration of the invention in which the parts illustrated are either standard items which can be purchased or are disclosed in sufficient detail when viewed in conjunction with the description.

As illustrated in FIG. 1, the reclaim system of this invention includes a heat exchanger 10, one portion of which is in fluid communication with a refrigerant intake fluid conduit 11 controlled by solenoid valve 12. The conduit 11 is in fluid communication with conduit 13 which constitutes the cold side of heat exchanger 10.

Conduit 16 constitutes the outlet from the cold side of heat exchanger 1? and is in fluid communication with oil separator 20 through the conduit 21. The fluid conduit 21 extends through the outer wall of the oil separator tank 20 somewhat above the lower end of the tank and extends inwardly so that its open end is near the axis of the tank. Another fluid conduit 22 has its open end fixed near the inner surface of the rounded top of the tank. This fluid conduit extends downwardly and supports a circular baffle 23 composed of a disc-like portion 24 and a downwardly extending partially cone-shaped skirt 25. Conduit 22 is arranged to extend along the axis of the tank and is connected to fluid conduits 26 and 31 controlled by a low pressure activated electrical control device 27 having a pressure gauge indicator associated with it. The control 27 will automatically shut down compressor 30 when the pressure in conduit 31 drops to virtually zero PSIG.

Fluid conduit 31 extends through the outer wall of compressor 30 and a short distance into its interior. Fluid conduit 70 also extends through the outer wall of compressor 30 and a short distance into its interior. Conduits 31 and 70 are designed to release refrigerant onto the electrical coils found within the compressor 30. Flow through conduit 70 into the compressor 30 is controlled by a low pressure activated electrical control device 71 and solenoid valve 74. The control device 71 is located so that it will open and permit liquid refrigerant to flow into the compressor 30 when solenoid valve 74 has been opened and the pressure within the compressor 30 drops to a preset level. Compressor 30 is provided with an oil sight gauge 73 and oil supply device 33. Operation of the compressor without adequate oil amounts will rapidly destroy the compressor, and frequent visual inspection of the oil level is crucial to maintain a refrigeration reclaim system. Outlet conduit 32 has a high pressure activated electrical control device 34 associated with it and is in fluid communication with conduit 15 of heat exchanger 10 and is thus in fluid communication with conduit 41, which in turn is in fluid communication with a condenser 40 through condenser inlet conduit 42. If pressure in conduit 32 is too high, control 34 acts automatically to shut down compressor 30.

Outlet conduit 43 connects condenser 40 in fluid communication with chill tank 50, which as illustrated is an elongated, cylindrical pressure tank arranged with its longitudinal axis extending vertically and having upper and lower ends of partially spherical shape. Outlet end 51 of fluid conduit 43 is located substantially on the axis of chill tank 50. At the bottom of the chill tank 50 there is a fluid conduit 52 controlled by solenoid valve 53 and arranged in fluid communication with the interior of chill tank 50. At the upper end of chill tank 50 there is an air outlet conduit 54 controlled by solenoid valve 55 having a pressure gauge indicator associated with it. Also located at the upper end of chill tank 50 is a high pressure activated safety valve.

Chill tank 50 is also provided with a float control 80. The float control 80 is in fluid communication with chill tank 50 via conduits 81 and 82. Conduit 82 is attached to the top of the float control 80 and enters the chill tank 50 at a point located somewhat below the upper end of the tank. Conduit 81 is attached to the bottom of float control 80 and enters the chill tank 50 at a point located approximately near the point midway between the upper and lower ends of the tank.

The float control 80 is located at a point outside of and next to the chill tank 50 at approximately the maximum level to which the chill tank may safely be filled with liquid refrigerant. As the level of liquid refrigerant in the chill tank 50 raises to a point above the place where conduit 81 enters the tank, the level of refrigerant within conduit 81 will be at substantially the same height as the level in the chill tank. When the level of liquid refrigerant in the chill tank 50 is at approximately the same height that the float control 80 is at, the float control will be activated and the inlet solenoid valve 12 will automatically shut. If refrigerant is removed from the chill tank 50 and the level of refrigerant in the tank falls below the height of the flow control, the inlet solenoid valve 12 shut-off will be deactivated.

Figure 2:
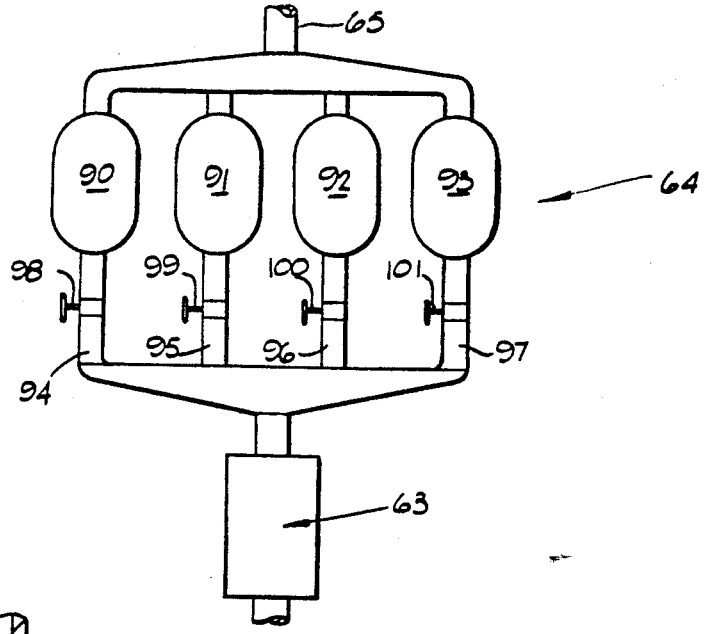
FIG. 2 is a view of an embodiment of the float device used for monitoring the level of liquid refrigerant in the reclaim holding tank.

FIG. 2 shows a more expanded view of a preferred embodiment of the float control 80. The float control 80 consists of a chamber 85 with a glass window, that contains a small magnet 83 which will float on the surface of the refrigerant and a solenoid switch 84. The height of the refrigerant in the chill tank 50 is approximately the same height that the refrigerant will be in the float control 80 and the conduit 81 feeding into the bottom of the float control 80. When the refrigerant level in the chill tank 50 reaches the height of the flow control 80, the magnet 83 floats on top of the refrigerant. When the top of the magnet reaches approximately the same level as the solenoid switch 84, the inlet solenoid valve 12 is automatically shut. When the magnet 83 drops below the level of the solenoid switch 84, the inlet solenoid valve 12 is no longer deactivated.

Figure 3:
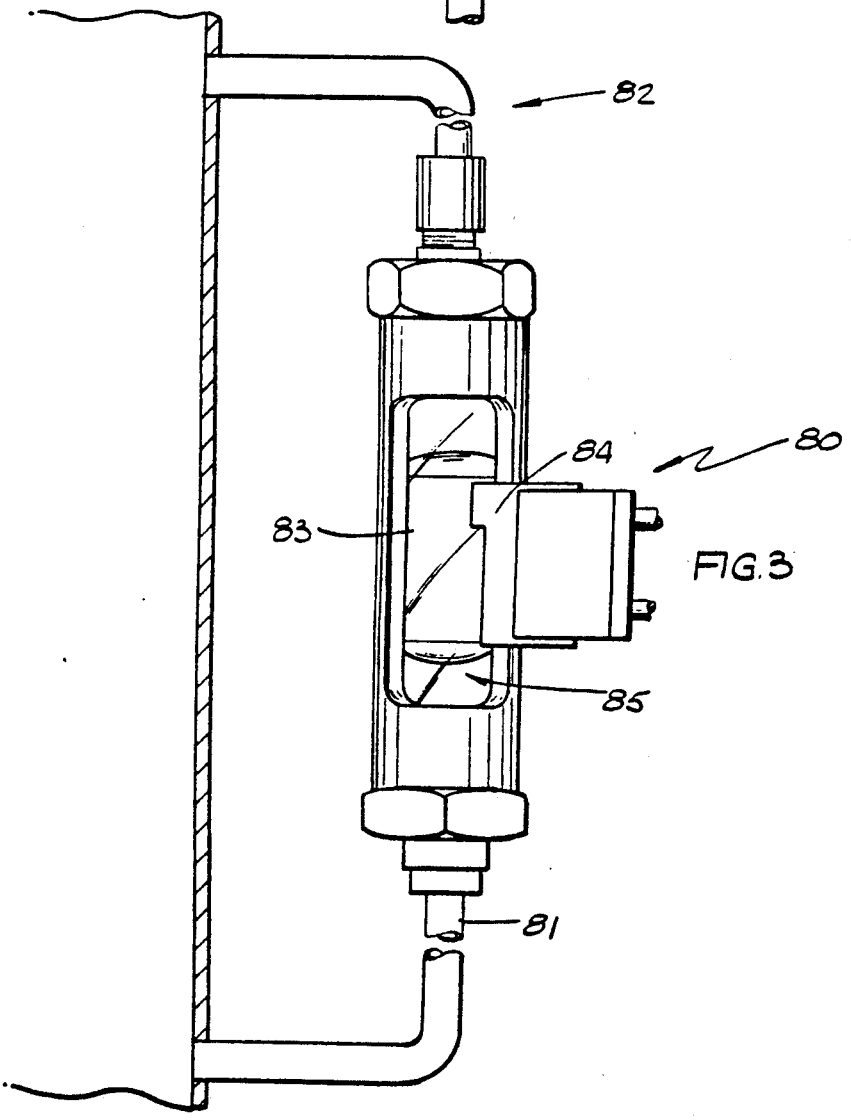
FIG. 3 is a schematic illustration of the expansion means portion of the invention.

Located partially within and partially outside chill tank 50 is a cooling and recycling system 60 composed of a conduit 61 in fluid communication with conduit 52 and controlled by solenoid valve 62. The fluid conduit 61 is in fluid communication with filter-dryer 63, which in turn is connected in fluid communication with expansion means 64. Fluid conduit 61 is also in fluid communication with inlet conduit 70 of compressor 30. The expansion means 64 is an electronically controlled device for directing the refrigerant exiting the filter dryer 63 into the appropriate expansion device 90, 91, 92 or 93 for the preselected refrigerant as shown in FIG. 3. Conduits 94, 95, 96 and 97 are in fluid communication with filter dryer 63 and controlled respectively by solenoid valves 98, 99, 100 and 101. Conduits 94, 95, 96 and 97 are in fluid communication with the respective expansion devices 90, 91, 92 and 93. The expansion devices 90, 91, 92 and 93 are in fluid communication with conduit 65 arranged in the form of a coil within the chill tank 50 The cooling coil 65 is in fluid communication with conduit 66, which is in turn in fluid communication with inlet conduit 31 of compressor 30.

All the elements of the reclaim system of this invention can be mounted within a mobile cabinet (not shown) having a control panel in one outer surface and casters underneath it.

The control panel includes a power on-off switch which, depending on the positions of various valves and the pressures at various points in the system, energizes the compressor 30 and the valves 12, 29, 55, 53 and 62. Since controls 27 and 34 shut down or start up compressor 30 automatically when the power is on, and since relief valve 56 responds automatically to pressure, the control panel need not include switches for manually activating these devices.

The control panel also includes a "vapor" on-off switch which activates the solenoid valve 74. The delivery of controlled amounts of liquid refrigerant into the compressor is only desired when small amounts of gaseous refrigerant are being removed from a vessel containing refrigerant. A steady stream of gaseous refrigerant being removed from a vessel as rapidly as the compressor 30 is able to process it, provides sufficient cooling to the electrical coils of the compressor motor to prevent overheating and subsequent burn out. However, when the last portion of refrigerant vapor is being evacuated from a vessel, the quantity of gaseous refrigerant entering the compressor 30 is insufficient to prevent compressor overheating. When the vapor switch is turned on solenoid valve 74 is opened, and the low pressure activated control 71 is capable of allowing controlled amounts of liquid refrigerant to enter into the compressor 30 via intake conduit 70 when the pressure in compressor 30 drops below a predetermined level. The low pressure activated control 71 is a pressurized diaphragm biased disk valve, including a pressure dome and diaphragm operator. The pressure dome defines a chamber closed by a flexible diaphragm. An adjusted gas pressure is established and maintained in the dome chamber, in opposition to a coil spring or other mechanical biasing device, to provide a constant, predetermined differential biasing force on the value at a given temperature. When the pressure in the compressor 30 drops below the preset level, the pressure in the pressure dome exerts enough pressure to open the valve, and allow liquid refrigerant into the compressor 30 through inlet conduit 70. The low pressure activated control 71 is more fully described in U.S. Pat. No. 4,718,245 of Van Steenburgh, Jr.

This liquid-injection cooling will only occur, however, when pressure in the compressor 30 is so low as to indicate that additional compressor 30 cooling will be required. By use of this liquid injection cooling system, it is possible to remove all refrigerant from a vessel without fear of destroying the compressor by overheating. It is, of course, crucial that the liquid injection occur only when the compressor motor has additional heat dissipation requirements due to the decreased presence of cooling gaseous refrigerant, and that only small amounts of liquid refrigerant be injected into the compressor 30. If the liquid refrigerant added to the compressor is not almost instantaneously vaporized, liquid refrigerant could enter the piston chamber and cause "liquid slugging."

The control panel also includes a switch which has settings to select the desired expansion device 90, 91, 92, 93 that would be appropriate for the particular refrigerant to be reclaimed. The setting selected on the control panel activates the appropriate solenoid valve 98, 99, 100, 101 to allow the refrigerant to enter into the corresponding expansion device 90, 91, 92, 93 in fluid communication with that solenoid valve. In this manner, the refrigerant will only go to one expansion device 90, 91, 92, 93 at a time.

In addition to these controls, the control panel needs only the following additional controls: (1) a switch for valve 12 (refrigerant in), (2) a switch for valve 29 (oil out), (3) a switch for valve 53 (refrigerant out), (4) a switch for valve 55 (air out), and (5) a switch for valve 62 (control for cooling and recycling system 60). The control panel also includes two pressure gauge indicators, one for displaying the pressure entering conduit 31 and the other for displaying the pressure at valve 55 and the upper portion of chill tank 50. Details of the circuitry for electrically connecting switches, controls, valves and gauges will be apparent to those skilled in this art.

The maintenance of proper amounts of oil in the compressor 30 is crucial to the long life of a refrigerant reclaim system. Due to the nature of piston driven compressors, some oil loss into the gaseous compressed refrigerant is inevitable. Although several devices are available for measuring and returning lost oil to compressors, they are generally of limited valve when the compressor is part of a refrigerant reclaim system, because the refrigerant being reclaimed also contains significant amounts of oil. As the amount of oil contained in the reclaimed refrigerant may vary substantially, any system that measures oil collected by the reclaim apparatus will not accurately reflect the oil content within the compressor. In accordance with the present invention, a sight gauge 73 is incorporated into the body of the compressor 30 in order to monitor the oil level within the compressor 30. This is the only way to accurately maintain the proper amounts of oil in the compressor 30. The sight gauge 73 consists of a window into the compressor 30 at a point on the compressor 30 where the oil is at the center of window when just the correct amount of oil is in the compressor 30.

In a preferred embodiment of the invention, chill tank 50, being the largest element of the reclaim system, and being about 48 inches in height, the cabinet should be about 62 inches in height including the height of the casters. The cabinet can be about 28 inches in width and 24 inches in depth if the cabinet contains the system illustrated in the drawing which has only one chill tank 50. Depending on the anticipated use of the reclaim system, the chill tank 50 can be of almost any size. Preferably, the chill tank is capable of storing between 25 and 50 pounds of refrigerant.

As will be apparent to those skilled in the art, if the cooling effect from one chill tank 50 is insufficient, or if additional refrigerant storage capacity is required, one or more additional chill tanks can be provided and connected to run in parallel with the first chill tank 50. In one preferred embodiment, each chill tank is about 6 inches in diameter, has a capacity to store or hold 45 lbs. of refrigerant such as R-12, R-22, R-502 or R-500 and meets ASME and Underwriters Laboratory specifications for pressure tanks. The tank for oil separator 20 preferably meets the same specifications and is 36 inches long and 6 inches in diameter. The following is a compilation of the items which are standard devices which can be purchased, together with an identification of these items:

| Item Description No. | Manufacturer | Identification No. |
|---|---|---|
| Compressor 30 | Copeland Corp. | SSC4-0200 |
| Condenser 40 | Snow Coil Co. | 5858M786 |
| Heat Exchanger 10 | Packless Industries | AES001672 |
| Control 34 | Ranco, Inc. | 016-42 |
| Control 27 | Penn Corp. | P70AB-2 |
| Solenoid Valves 12, 62, 55, 53, 29, 74, 98, 99, 100, 101 | Sporelan Valve Co. | E35-130 |
| Safety Valve 56 | Superior | 3014-400 |
| Gauges on control panel | Ashcroft | Laboratory quality 1377-AS |
| Filter-Drier 63 | Sporelan Valve Co. | 384 cubic in. |
| Float control 80 | Watsco, Inc. | RLM-1 |
| Expansion Devices 90, 91, 92, 93 | Sporelan Valve Co. | |

A unit constructed as disclosed above weighs about 325 lbs.

When the system illustrated is utilized in repair of the refrigerating systems of an air conditioner, for example, fluid conduit 11 is connected to a refrigerant outlet in the refrigeration system, the power is turned on and valve 12 is opened, FIG. 1. Control 27 at the inlet to the compressor is activated when it senses pressure in fluid conduit 31, and with the power turned on, compressor 30 begins to function. Refrigerant from the reclaim system is drawn into the reclaim system through conduit 11. Normally the refrigerant at this point will be liquid, which has been illustrated in the drawings by double cross-hatching inside the fluid conduit. When withdrawing liquid from the refrigeration system, the "vapor" switch should be in the off position. At some point in fluid conduit 13 of heat exchanger 10 the refrigerant is converted to gaseous form by the heat transferred to it from conduit 15 carrying the output of compressor 30. The single cross-hatching in fluid conduit 13 is illustrative of refrigerant in gaseous form. Through FIG. 1 double cross-hatching indicates liquid and single cross-hatching gas or vapor. The refrigerant flows through fluid conduits 16 and 21 into oil separator 20. The refrigerant is relatively hot at this point and is an expanding gas rising rapidly within the tank of the oil separator 20. The upward flow of gas is abruptly interrupted by the baffle 23 causing oil to be separated and to drop to the bottom of the tank. The gaseous refrigerant passes around the outer (lower) edge of skirt 25 which is spaced from the interior wall of the surrounding tank by an amount providing a total open area which is approximately equal to the open area at the upper end of conduit 22. The gaseous refrigerant passes around skirt 25 into the upper end of fluid conduit 22, then through fluid conduit 26 into fluid conduit 31.

So long as there is sufficient pressure in the fluid conduit 31 to indicate that the refrigeration system of the air conditioner has not been completely evacuated, compressor 30 will continue to run. When all of the liquid refrigerant has been removed and only some gaseous refrigerant remains or only gaseous refrigerant is being reclaimed, the vapor switch should be in the on position. When the vapor switch has been turned on, solenoid valve 74 is opened and liquid refrigerant in conduit 70 may enter compressor 30 as allowed by low pressure activated control 71. The liquid injection cooling system, whereby controlled amounts of liquid refrigerant are directly released into the compressor 30 at inlet conduit 70 will only occur when the pressure in the compressor 70 indicates that there is not sufficient amounts of gaseous refrigerant in the system to assure adequate cooling of the compressor motor.

Refrigerant from fluid conduit 31 passes into the compressor 30, is compressed and discharged through fluid conduit 32 and passes the heat exchanger in fluid conduit 15 and then through fluid conduit 41 into condenser 40 through condenser inlet 42. The gaseous refrigerant entering the condenser is converted into a liquid at some point in the condenser such as 44.

Liquid refrigerant passes out of the condenser 40 into conduit 43 and through that conduit into the upper portion of chill tank 50. At this point, valves 53 and 62 are closed and the compressor will continue to withdraw refrigerant from the refrigeration system of the air conditioner, and to cause liquid refrigerant to be discharged into chill tank 50 until the pressure at the inlet to compressor 30 drops to virtually zero PSIG indicating all of the refrigerant has been removed from the refrigeration system of the air conditioner. At this point, control 27 will act to shut down compressor 30. When the vapor switch is on, the liquid injection of refrigerant will provide enough pressure in the compressor 30 to prevent control 27 from shutting down the compressor. When the source pressure and the system pressure are both the same, the vapor switch may be turned off and the system will quickly evacuate all traces of refrigerant and the compressor will shut off before any compressor overheating can occur.

In the situation where the refrigeration system being drained of refrigerant holds more refrigerant than the chill tank 50 can safely hold, the compressor 30 will be automatically shut down when the float control 80 indicates that the chill tank's capacity has been reached and the inlet solenoid valve 12 is shut.

After all of the refrigerant has been removed from the refrigeration system, the operator will close valve 12 (refrigerant intake) and open valve 62 causing liquid refrigerant to leave the chill tank 50 through fluid conduit 52 and into filter dryer 63 through fluid conduit 61. If solenoid valve 74 and low pressure activated control 71 are open, a controlled amount of liquid refrigerant may be directed through conduit 71 into the compressor 30. The liquid refrigerant then passes through the expansion means 64. Depending on the particular refrigerant setting indicted on the control panel, one of the solenoid valves 98, 99, 100, 101 will be opened, and the refrigerant will flow through the appropriate conduit 94, 95, 96, 97 to the respective expansion device 90, 91, 92, 93, where it is converted into a gas and passes through coil 65 to cool the liquid refrigerant, illustrated in the drawing as filling approximately ¾ of chill tank 50 and having the coil 65 submerged in it. When expanding gas from coil 65 reaches the compressor inlet conduit 31 via fluid conduit 66, there will be sufficient pressure to actuate control 27, and the compressor will automatically start running again.

When valve 12 is closed, the cold side of the heat exchanger 10 and the entirety of oil separator 20 are shut down. With pressure in fluid conduit 31, the compressor continues to operate and the gaseous refrigerant which entered the compressor through conduits 66 and 31 is compressed and discharged from the compressor through fluid conduit 32 and thence through the heat exchanger 10 and condenser 40 back into the chill tank 50. The cycle just described is repeated continuously until the temperature of the liquid refrigerant in chill tank 50 has been reduced to the desired level, normally about 38 to 45 degrees Fahrenheit.

The repeated passing of liquid refrigerant through filter dryer 63 removes substantially all acid and water from the liquid refrigerant. During this recycling, normally a certain amount of air will also be separated from the refrigerant and accumulated in the upper portion of chill tank 50, causing the pressure to rise in the chill tank 50. Air may be removed from the reclaim system by opening valve 55 so that the air escapes through conduit 54. This is normally done when the pressure within the chill tank 50 reaches something in excess of 300 PSIG and is accomplished by activating a switch on the control panel. In the unlikely event that pressure in the chill tank 50 should reach a level of about 325 PSIG, safety valve 56 will be actuated and gases in the system will be vented. Preferably, there is an additional control for releasing gaseous contents of the chill tank 50 into the atmosphere should the pressure in the tank reach a level of about 400 PSIG. Such control may take the form of a pressure sensitive spring loaded ball bearing. Of course, the action of the float control 80 will generally prohibit filling of the chill tank 50 to a level that would require use of the back up safety devices for relieving excess pressure in the chill tank.

Before any liquid refrigerant is returned to the vessel from which it was removed, which is done by closing valve 62 and opening valve 53, any oil which has been collected in the bottom of oil separator 20, as schematically illustrated in the drawing, should be removed from the oil separator 20 through outlet 28 by opening valve 29. The amount of oil removed should be measured so that an appropriate amount of oil can be resupplied to the refrigeration system.

The refrigerant reclaim system of this invention may also be utilized to transfer refrigerant from one container to another. This is accomplished by connecting the fluid conduit 11 to the container from which refrigerant is to be taken (the first container) and fluid conduit 52 to the receiving or second container. Upon opening valve 12 and supplying power to compressor 30, refrigerant will be removed from the first container and passed through heat exchanger 10, the oil remover 20, the compressor 30, the condenser 40, and into chill tank 50. Operation is continued in this mode until the pressure display on the control panel indicates the first container has been evacuated. As in the other operations, when all of the refrigerant has been removed from the first container, pressure in line 31 will drop to virtually zero PSIG, thus activating control 27 and shutting off the compressor which will not begin to run again until there is pressure in line 31 from the gaseous refrigerant exiting from the cooling device 60. When the final amounts of refrigerant in the first container is vapor, the vapor switch should be turned on, thus activating the liquid injection system by opening solenoid valve 74. When the first container is totally evacuated the vapor switch is turned off and valve 12 is then closed. Since it will facilitate discharging the refrigerant into the second container, it is desirable that valve 53 first be closed and valve 62 opened so that cooling device 60 will be operative. Operation in this mode is continued for a sufficient period to reduce the liquid refrigerant in chill tank 50 to the desired temperature. When the desired temperature is reached, valve 62 is closed, valve 53 opened, and liquid refrigerant will flow from the chill tank 50 into the receiving container by gravity, and any pressure from gases in the upper portion of chill tank 50.

I claim:

1. In an apparatus for reclaiming refrigerant comprising, in combination, means for removing gaseous or liquid refrigerant from a container, vaporizing all of said liquid refrigerant and separating oil from the gaseous refrigerant, a compressor for receiving and compressing said gaseous refrigerant from said container, a condenser for receiving and condensing said gaseous refrigerant from said compressor, and means for receiving and storing said liquid refrigerant from said condenser, the improvement of liquid injection means in fluid communication with said compressor, whereby said liquid injection means inject controlled amounts of liquid refrigerant into said compressor in order to prevent overheating of the compressor.

2. The improvement of claim 1, wherein said means for receiving and storing said refrigerant is in fluid communication with said liquid injection means in order to supply liquid refrigerant to the compressor.

3. The improvement of claim 1, wherein the addition of said controlled amounts of liquid refrigerant is controlled by valve means that permit injection of liquid refrigerant into said compressor when the pressure in said compressor drops to a certain predetermined level.

4. The improvement of claim 3, wherein said valve means is a pressurized diaphragm biased disc valve.

5. In an apparatus for reclaiming refrigerant that has cleaning means for holding refrigerant within the apparatus while repeatedly cleaning and cooling the refrigerant said cleaning means comprising, in combination, means for removing refrigerant from a container and separating oil from the refrigerant, a compressor for receiving and compressing said refrigerant from said container, a condenser for receiving and condensing said refrigerant from said compressor, and storage means for receiving and storing said refrigerant, the improvement where said storage means is equipped with float control means, said float control means operating to automatically shut off said means for removing refrigerant from a container when a certain predetermined level of refrigerant is continued within said storage means, said float control means is comprised of switch means attached externally to the storage means, said switch means being in fluid communication with said storage means by first and second conduits, said switch means being positioned at a height such that it will be activated to shut off said means for removing refrigerant from a container when a predetermined level of refrigerant in said storage means is reached.

6. The improvement of claim 5, wherein said switch means is comprised of a floating magnet and a magnetically activated switch, said floating magnet is capable of floating on the surface of said refrigerant within the switch means, whereby the raising of said floating magnet within said control means operates to activate said magnetically activated switch.

7. The improvement of claim 5 wherein said first conduit is attached to the top of said float control means and to a point somewhat below the upper end of said storage means and said second conduit is attached to the bottom of said float control means and to a point approximately near the middle of said storage means.

8. In an apparatus for reclaiming refrigerant that has cleaning means for holding refrigerant within the apparatus while repeatedly cleaning and cooling the refrigerant, said cleaning means comprising, a compressor for compressing and discharging gaseous refrigerant, means for condensing the gaseous refrigerant to a liquid, means for conducting the liquid refrigerant into a closed elongated chill tank, means for withdrawing the liquid refrigerant from the bottom of said chill tank and passing it successively through a filter-drier, expansion means and a fluid conduit within the chill tank extending upwardly from the lower portion of the chill tank, and means outside the chill tank for connecting the fluid conduit in fluid communication with the intake of the compressor, the improvement wherein said expansion means consists of a plurality of expansion valves that are each in fluid communication with said filter-drier and said fluid conduit within the chill tank.

9. The improvement of claim 8 wherein the filter-drier is attached to a plurality of conduits leading to said expansion devices, said conduits each being equipped with flow control means upstream from said expansion devices.

10. The improvement of claim 9 wherein only one of said flow controls can be activated at a time, whereby liquid refrigerant will flow successively through said filter-drier into only one of said conduits, into the corresponding expansion devise, and into said fluid conduit within the chill tank.

* * * * *